US011599038B2

(12) United States Patent
Maezawa

(10) Patent No.: US 11,599,038 B2
(45) Date of Patent: Mar. 7, 2023

(54) DEVELOPING DEVICE AND IMAGE FORMING APPARATUS PROVIDED THEREWITH

(71) Applicant: KYOCERA Document Solutions Inc., Osaka (JP)

(72) Inventor: Nobuhiro Maezawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/764,694

(22) PCT Filed: Jan. 13, 2021

(86) PCT No.: PCT/JP2021/000784

§ 371 (c)(1),
(2) Date: Mar. 29, 2022

(87) PCT Pub. No.: WO2021/149547

PCT Pub. Date: Jul. 29, 2021

(65) Prior Publication Data

US 2022/0365461 A1 Nov. 17, 2022

(30) Foreign Application Priority Data

Jan. 24, 2020 (JP) ..... JP2020-009580

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
None
See application file for complete search history.

(56) References Cited

U.S. PATENT DOCUMENTS

2001/0036376 A1* 11/2001 Yamazaki ..... G03G 15/0808 399/281
2001/0048828 A1* 12/2001 Ishii ..... G03G 15/0812 399/272

(Continued)

FOREIGN PATENT DOCUMENTS

JP H05-257375 10/1993
JP H08-106213 4/1996

(Continued)

*Primary Examiner* — Sevan A Aydin
(74) *Attorney, Agent, or Firm* — Lex IP Meister, PLLC

(57) ABSTRACT

A developing device capable of stably collecting untransferred toner collected from the photoconductor drum to the developing roller to the feed roller and suppressing occurrence of development ghosts, and an image forming apparatus including the same are provided. A developing device has a developing roller facing a photoconductor drum, a feed roller, and a restriction blade. The feed roller forms a feed nip part with the developing roller by contacting with the circumferential surface of the developing roller, and collects toner from the developing roller while feeding the toner to the developing roller. The Asker-C hardness of the developing roller is in the range of 50 to 80, both inclusive, the width of the feed nip part is in the range of 0.2 to 1.5 mm, both inclusive, and a compressive load to be applied to the feed roller is in the range of 0.2 to 1.5N, both inclusive.

7 Claims, 3 Drawing Sheets

(56) References Cited

U.S. PATENT DOCUMENTS

| | | | | |
|---|---|---|---|---|
| 2009/0003863 | A1* | 1/2009 | Hagiwara | G03G 15/0818 399/58 |
| 2013/0236217 | A1* | 9/2013 | Nagatomo | G03G 9/09716 399/281 |
| 2022/0019155 | A1* | 1/2022 | Maezawa | G03G 15/0812 |

FOREIGN PATENT DOCUMENTS

| | | | | | |
|---|---|---|---|---|---|
| JP | 2000-338776 | | | 12/2000 | |
| JP | 2002023432 | A | * | 1/2002 | G03G 15/0806 |
| JP | 2003-021957 | | | 1/2003 | |
| JP | H08272138 | A | * | 12/2003 | |
| JP | 2005-127480 | | | 5/2005 | |
| JP | 2009042566 | A | * | 2/2009 | |
| JP | 2009058736 | A | * | 3/2009 | |
| JP | 2009271415 | A | * | 11/2009 | |
| JP | 2010079010 | A | * | 4/2010 | |
| JP | 2018-005017 | | | 1/2018 | |
| KR | 20200123031 | A | * | 12/2020 | |

* cited by examiner

DEVELOPING DEVICE AND IMAGE FORMING APPARATUS PROVIDED THEREWITH

TECHNICAL FIELD

The present invention relates to a developing device for developing an electrostatic latent image formed on a photoconductor drum using a non-magnetic one-component developer, and to an image forming apparatus provided therewith.

BACKGROUND ART

Conventionally, a developing device disclosed in Patent Literature 1, which is used in an image forming apparatus such as a printer and develops an electrostatic latent image formed on a photoconductor drum using a non-magnetic one-component developer, is known. In such a developing device, by setting a compression set of a feed roller to supply toner to the developing roller and a contact depth of the feed roller with the developing roller within a specific range, the stress on a toner is reduced and image defects such as a toner fogging are prevented.

Patent Literature 2 discloses that a number of pores are formed on a surface of the feed roller with an elasticity, and an inner diameter of the pores is set to become narrower toward the inside in a radial direction. This allows the toner to be suppressed from deeply penetrating into the pores, and thus preventing the feed roller from deteriorating the elasticity due to a toner aggregation in the pores.

CITATION LIST

Patent Literature

Patent Literature 1: Japanese Patent Laid-open Publication No. 1996-106213

Patent Literature 2: Japanese Patent Laid-open Publication No. 1993-257375

SUMMARY OF THE INVENTION

Problems to be Solved by the Invention

In the technology disclosed in Patent Literature 1, there was a problem that, even when the contact depth of the feed roller with the developing roller is set within the above specific range, it is difficult to sufficiently collect the toner with a small particle diameter from the developing roller to the feed roller, image defects such as development ghosts are likely to occur as a result. In the technology disclosed in Patent Literature 2, there was a problem that, it is difficult to sufficiently collect the toner remained on the developing roller without being supplied to a photoconductor drum by the feed roller, image defects such as development ghosts are likely to occur due to a mixture of a new toner and the toner which cannot be collected on the developing roller.

The present invention was made to solve the above-mentioned problems, and in particular to provide a developing device capable of stably collecting untransferred toner collected from the photoconductor drum to the developing roller to the feed roller and suppressing occurrence of development ghosts, and to provide an image forming apparatus including the same.

Means for Solving the Problem

According to an aspect of the present invention, a developing device includes: a developing housing containing a non-magnetic one-component toner; a developing roller having a cylindrically shaped elastic body, that is rotatably supported by the developing housing, and is located at a developing nip part so as to face a specific photoconductor drum to carry the toner on a circumferential surface of the developing roller; a feed roller having a cylindrically shaped foam elastic body, that is rotatably supported by the developing housing, forms a feed nip part between the feeding roller and the developing roller by being brought into contact with the circumferential surface of the developing roller, and collects the toner from the developing roller while supplying the toner to the developing roller; and a layer thickness regulating member to regulate a thickness of the toner on the developing roller, that is brought into contact with the circumferential surface of the developing roller on a downstream side from the feed nip part in a rotation direction of the developing roller, wherein a hardness of the developing roller is set within a range from 50 to 80, both inclusive, in Asker-C hardness, a width of the feed nip part along the rotation direction of the developing roller is set within a range from 0.2 mm to 1.5 mm, both inclusive, and a compressive load applied to the feed roller is set within a range from 0.2N to 1.5N, both inclusive.

According to this configuration, the toner supplied from the feed roller to the developing roller can be stably maintained, while preventing the occurrence of an uneven image density. Therefore, when the feed roller collects the undeveloped toners from the developing roller, the collectability can be improved. In addition,the difference in toner charge between the undeveloped toners and the toner newly supplied from the feed roller to the developing roller makes it possible to suppress a development ghost (ghost) from occurring.

In the above mentioned configuration, it is preferable that the hardness of the surface of the feed roller is set within the range from 30 to 50, both inclusive, in Asker-FP hardness.

According to this configuration, it is possible to prevent the developing ghost from occurring due to toners slipping through the feed nip part because of too low hardness of the feed roller as well as to suppress torque for rotating the feed roller from significantly increasing because of too high hardness of the feed roller.

In the above mentioned configuration, it is preferable that a melt viscosity (Pa·s) of the toner at 95° C. is set within a range from 10000 to 20000, both inclusive.

According to this configuration, even the toner with a relatively low melt viscosity and viscosity likely to increase according to the temperature in the device, it is possible to achieve both the toner supply to the developing roller by the feed roller and the toner collection from the developing roller by the feed roller.

According to another aspect of the present invention, an image forming apparatus includes: a developing device mentioned above; and a photoconductor drum having a surface on which an electrostatic latent image is formed, and being supplied with the toner from the developing roller.

According to this configuration, it is possible to provide the image forming apparatus capable of suppressing the occurrence of uneven image density and development ghosts using non-magnetic toner.

Effect of the Invention

According to the present invention, a developing device capable of stably collecting untransferred toners collected from the photoconductor drum to the developing roller to the feed roller and suppressing occurrence of development ghosts, and an image forming apparatus including the same are provided.

MODE FOR CARRYING OUT THE INVENTION

Figure 1:
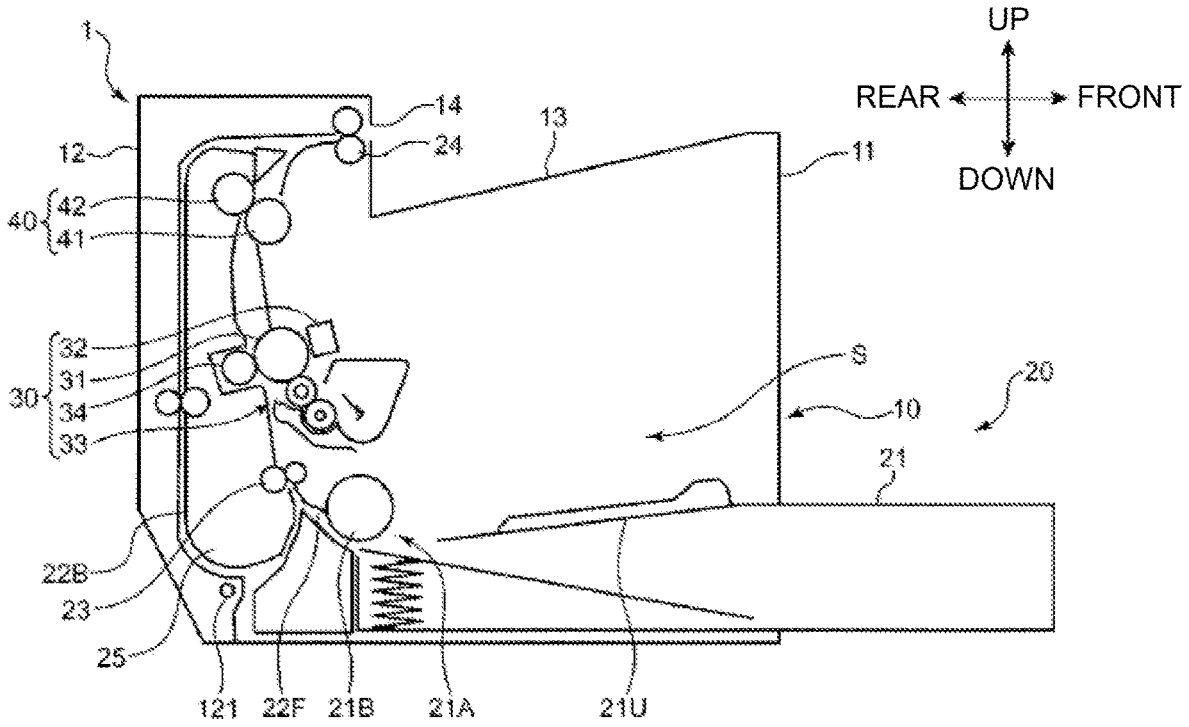
FIG. 1 is a cross-sectional view illustrating the internal structure of an image forming apparatus according to an embodiment of the present invention.

Now some embodiments of the present invention will be described below in detail with reference to the drawings. FIG. 1 is a side-cross-sectional view illustrating the internal structure of an image forming apparatus 1 according to an embodiment of the present invention. Hereinafter, although a monochrome printer is illustrated as the image forming apparatus 1, the image forming apparatus 1 may be a copier, a facsimile machine, or a multifunction machine equipped with these functions, may be a color imaging device which forms color images.

The image forming apparatus 1 includes a body housing 10 with a substantially rectangular-shaped housing structure, a paper feeding part 20, an image forming unit 30, and a fusing part 40, which are enclosed in the body housing 10.

A front cover 11 and a rear cover 12 are provided on the front and rear sides of the body housing 10, respectively. The rear cover 12 is a cover which is opened at a sheet jam or maintenance. A paper discharging part 13, on which image-formed sheets rest, is attached to a top surface of the body housing 10. Various devices for performing image formation are installed in an inner space S defined by the front cover 11, the rear cover 12, and the paper discharging part 13.

The paper feeding part 20 includes a paper feeding cassette 21 to accommodate the sheets on which an image is formed. A portion of the paper feeding cassette 21 protrudes forward from a front surface of the body housing 10. A top surface of a portion of the paper feeding cassette 21, which is inserted and held in the body housing 10, is covered with a paper feeding cassette top plate 21U. The paper feeding cassette 21 has a sheet storage space to accommodate a bundle of sheets, a lift plate to lift the bundle of sheets up for feeding a sheet, and the like. A sheet feeding out part 21A is provided at the top on the rear end side of the paper feeding cassette 21. A paper feeding roller 21B, which feeds out a top-layer sheet in the bundle of sheets in the paper feeding cassette 21 one by one, is located in the vicinity of the sheet feeding out part 21A.

The image forming unit 30 performs an image forming operation to form a toner image on the sheet delivered from the paper feeding part 20 The image forming unit 30 includes a photoconductor drum 31, a charger 32, an exposure device (not shown in FIG. 2), a developing device 33, and a transfer roller 34, which are arranged around the photoconductor drum 31.

The photoconductor drum 31 has a rotation axis and a cylindrical surface which rotates around the rotation axis. An electrostatic latent image is formed on the cylindrical surface, and a toner image corresponding to the electrostatic latent image is carried on the cylindrical surface. An OPC photoconductor drum can be used as the photoconductor drum 31.

The charger 32 charges the surface of the photoconductor drum 31 uniformly and includes a scorotron spaced at a specific distance apart from the photoconductor drum 31 and discharging when a specific voltage is applied.

The exposure device has a laser light source and optical system equipment such as mirrors and lenses and irradiates light modulated on the basis of image data given by an external device such as a personal computer onto an outer circumferential surface of the photoconductor drum 31 to form an electrostatic latent image.

The developing device 33 supplies toner to the outer circumferential surface of the photoconductor drum 31 to develop the electrostatic latent image on the photoconductor drum 31 and form a toner image.

The transfer roller 34 is a roller causing the toner image formed on the outer circumferential surface of the photoconductor drum 31 to be transferred onto a sheet. The transfer roller 34 is brought into contact with the cylindrical surface of the photoconductor drum 31 so that a transfer nip part is formed. A transfer bias with a polarity opposite to a polarity of the toner is applied to the transfer roller 34.

The fusing part 40 performs a fusing process to fix the transferred toner image on the sheet. The fusing part 40 includes a fusing roller 41 with a heating source inside and a pressurizing roller 42 which is pressurized against the fusing roller 41 so as to form a fusing nip part between the fusing roller 41 and the pressurizing roller 42. When the sheet on which the toner image has been transferred passes through the fusing nip part, the toner image is fixed on the sheet by heating the sheet with the fusing roller 41 and pressurizing the sheet with the pressurizing roller 42. In this embodiment, the melt viscosity (Pa·s) of a non-magnetic one-component toner used in the developing device 33 at a temperature 95° C. is set in a range from 10000 to 20000, both inclusive.

A main transport path 22F and a reverse transport path 22B are provided in the body housing 10 to transport the sheet. The main transport path 22F extends from the sheet feeding out part 21A of the paper feeding part 20, via the image forming unit 30 and the fusing part 40, to a paper discharging port 14 provided to face the paper discharging part 13 on the top surface of the body housing 10. The reverse transport path 22B is a transfer path through which the one-side-printed sheet is returned to the upstream side of the image forming unit 30 in the main transport path 22F when a duplex printing is performed on the sheet.

The main transport path 22F extends from downward to upward so as to pass through the transfer nip part formed by the photoconductor drum 31 and the transfer roller 34. A resist roller pair 23 is located on the upstream side of the transfer nip part in the main transport path 22F. The sheet is stopped once at the resist roller pair 23 and fed out into the transfer nip part at a specific timing for an image transfer after skew correction is performed. A plurality of transport rollers for transporting the sheet are arranged at appropriate locations in the main transport path 22F and the reverse transport path 22B. For example, a paper discharging roller pair 24 is arranged in the vicinity of the paper discharging port 14.

The reverse transport path 22B is formed between the outer surface of a reversing unit 25 and the inner surface of the rear cover 12 of the body housing 10. The transfer roller 34 and one of the resist roller pair 23 are mounted on the inner surface of the reversing unit 25. The rear cover 12 and the reversing unit 25 can be rotatable around an axis of a fulcrum 121 provided at a lower end thereof. In the event that a sheet jam occurs in the reverse transport path 22B, the rear cover 12 is opened. In the event that a sheet jam occurs in the main transport path 22F or that a unit of the photoconductor drum 31 or the developing device 33 is removed outside, the reversing unit 25 is also opened along with the rear cover 12.

Figure 2:
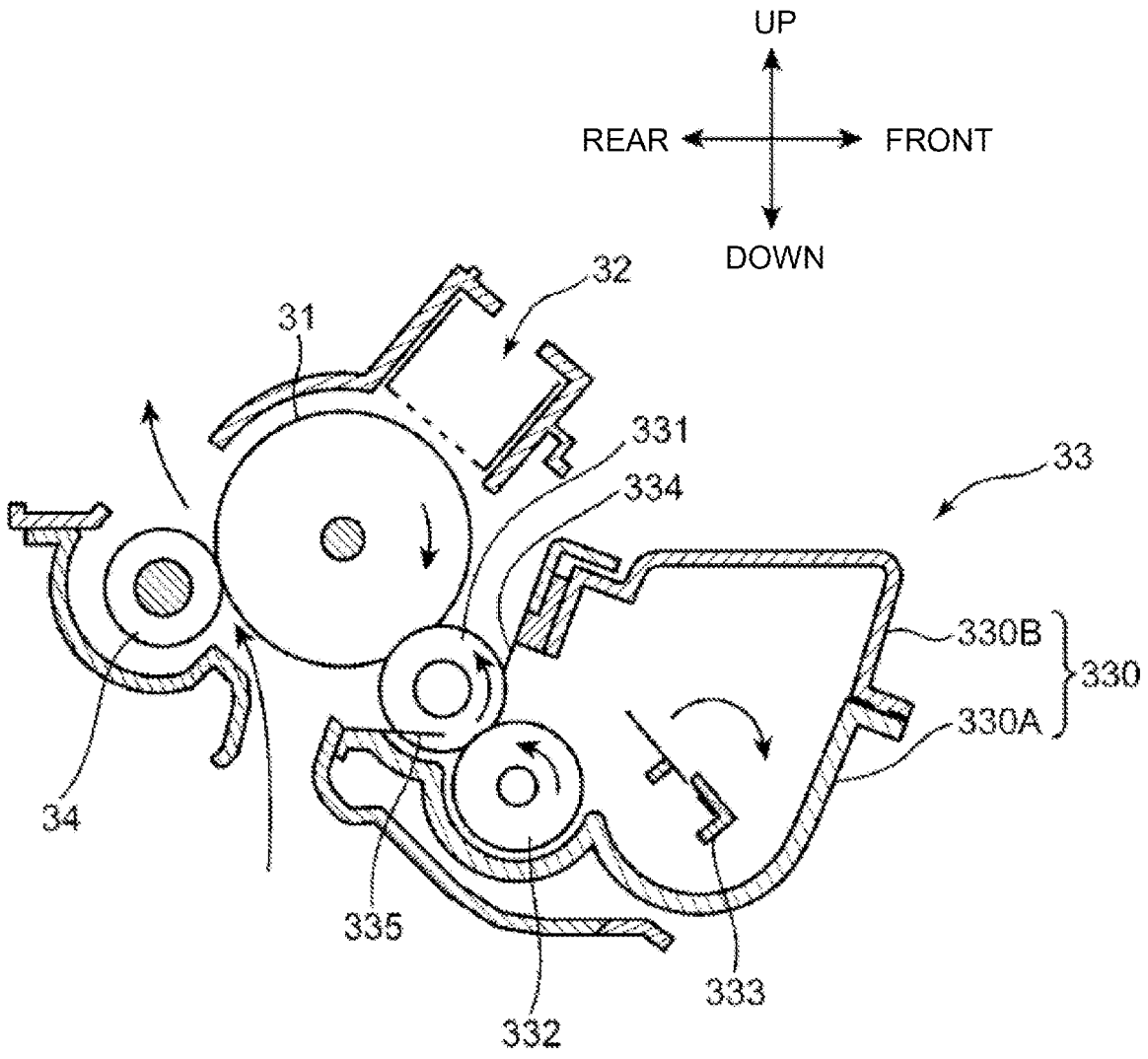
FIG. 2 is a cross-sectional view of a periphery of the photoconductor drum of the image forming apparatus of according to the embodiment of the present invention.

FIG. 2 shows a cross-sectional view of a peripheral structure of the photoconductor drum 31. In this embodiment, the transfer roller 34 is located to be brought into contact with the photoconductor drum 31 in the rear of the photoconductor drum 31, and the charger 32 is located to face the photoconductor drum 31 with being spaced at a specific distance away therefrom in front of and above the photoconductor drum 31. The transfer nip part is formed between the photoconductor drum 31 and the transfer roller 34, and the sheet passes through the transfer nip part as shown by the arrow in FIG. 2. At this time, the toner image is transferred from the photoconductor drum 31 to the sheet.

The developing device 33 is located in front of and below the photoconductor drum 31 so as to face the photoconductor drum 31. The developing device 33 includes a developing housing 330, a developing roller 331, a feed roller 332, a stirring paddle 333, a restriction blade 334 (layer thickness regulating member), and a lower seal 335 (sealing member).

The developing housing 330 encloses a non-magnetic one-component toner inside. The developing housing 330 has a housing body 330A and a housing lid 330B. As shown in FIG. 2, an opening to expose a portion of the developing roller 331 to the photoconductor drum 31 side is formed at the rear end of the developing housing 330.

The developing roller 331 is rotatably supported by the developing housing 330 and has a circumferential surface to carry the toner. The developing roller 331 is brought into contact with the photoconductor drum 31 and forms together with the photoconductor drum 31 the developing nip part to supply the toner to the photoconductor drum 31. The developing roller 331 has a cylindrical rubber layer (elastic member) formed around a shaft made of SUS or SUM material. The rubber layer is made of NBR (Nitril -ButadieneRubber) rubber, for example. A specific coating layer may be formed on the surface of the rubber layer. In this embodiment, the hardness of the surface of the developing roller 331 is set within the range from 50 to 80, both inclusive, in the Asker-C hardness.

The feed roller 332 is located in front of and below the developing roller 331 so as to face the developing roller 331 and rotatably supported by the developing housing 330. The feed roller 332 is brought into contact with the developing roller 331 and forms a feed nip part to supply the toner to the developing roller 331. The feed roller 332 is formed by a cylindrical urethane sponge or a foamed sponge (both of which are elastic foams) fixed around a specific shaft. In this embodiment, the hardness of the surface of the feed roller 332 is set within the range from 30 to 50, both inclusive, in the Asker-FP hardness. A width of the feed nip part is set in the range from 0.2 mm to 1.5 mm, both inclusive, in a rotation direction, as viewed along a radial direction.

The stirring paddle 333 is rotatably supported in the developing housing 330 in front of the feed roller 332. As shown in FIG. 2, the stirring paddle 333 includes an L-shaped shaft in a cross-sectional view and a PET film disposed on the shaft so as to extend from the shaft along a radial direction.

FIG. 2 illustrates rotation directions of the developing roller 331, the feed roller 332, and the stirring paddle 333 when the image forming apparatus 1 performs an image forming operation on the sheet. The developing roller 331 rotates so that the surface of the developing roller moves in the same direction as the surface of the photoconductor drum 31 in a developing nip part. As an example, a circumferential speed ratio between the photoconductor drum 31 and the developing roller 331 is set to 1:1.55. The feed roller 332 rotates so that the surface of the feed roller moves in the opposite direction to the surface of the developing roller 331. A circumferential speed ratio between the feed roller 332 and the developing roller 331 is set to 1:1.55. The stirring paddle 333 rotates so as to scoop up the toner inside the developing housing 330 and supply it to the feed roller 332.

The restriction blade 334 is brought into contact with the surface (circumferential surface) of the developing roller 331 on the downstream side from the feed nip part in the rotation direction of the developing roller 331 and on the upstream side from the development nip part in the rotation direction of the developing roller 331. The restriction blade 334 is fixed to the developing housing 330 so as to incline toward the upstream side in the rotation direction of the developing roller 331. The restriction blade 334 regulates the thickness (layer thickness) of the toner deposited on the developing roller 331.

The lower seal 335 is supported by a housing body 330A to seal a gap between the developing roller 331 and the housing body 330A on the opposite side to the restriction blade 334. A tip of the lower seal 335 is brought into contact with the surface of the developing roller 331.

In this embodiment, as shown in FIG. 2, the charger 32 is located on the downstream side from the transfer nip part formed by the photoconductor drum 31 and the transfer roller 34 in the rotation direction of the photoconductor drum 31, and a so-called cleaner-less configuration in which none of the known cleaning devices is provided is employed. Namely, when the toner image is transferred from the photoconductor drum 31 to the sheet in the transfer nip part, untransferred toners remain on the photoconductor drum 31. The untransferred toners pass through the charger 32 and is collected from the photoconductor drum 31 by the developing roller 331 of the developing device 33. In a case where images (toner images) are continuously formed on the sheet, the developing roller 331 continues to supply the toner for the electrostatic latent image on the photoconductor drum 31, while collecting the untransferred toners from the photoconductor drum 31.

On the other hand, the feed roller 332 collects toners not having been supplied to the photoconductor drum 31 from the developing roller 331, while supplying new toner to the developing roller 331 in the feed nip part.

In such a way that the feed roller 332 collects from the developing roller 331 the toners not having been used for developing on the photoconductor drum 31, due to a lot of toner amount unable to completely collected by the feed roller 332 from the developing roller 331, so that uncollected toners rotate on the developing roller 331. It causes a difference in a toner charged amount between the uncollected toners and the newly supplied toner, so that image defects such as development ghosting may occur.

Figure 3:
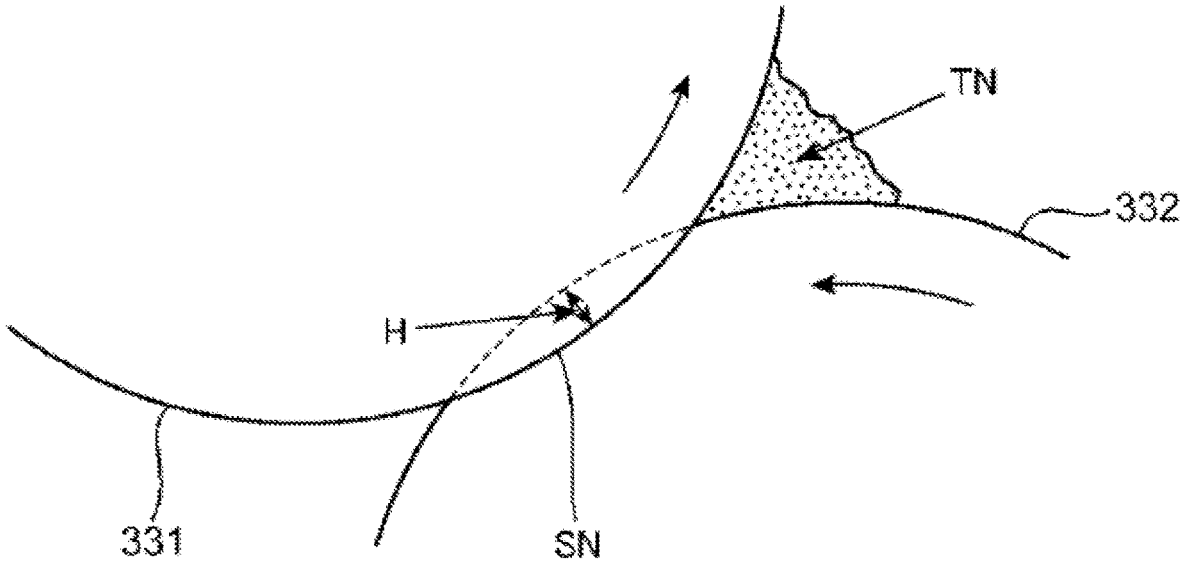
FIG. 3 is an enlarged cross-sectional view illustrating a feed nip part between a developing roller and a feed roller of a developing device according to the embodiment of the present invention.

FIG. 3 is an enlarged cross-sectional view illustrating a portion where the developing roller 331 faces the feed roller 332 of the developing device 33 according to the embodiment of the present invention. In this embodiment, the shafts of the developing roller 331 and the feed roller 332 are each supported by the developing housing 330 such that the surface of the developing roller 331 bites the surface of the feed roller 332 by biting amount H. As a result, a feed nip part SN between the developing roller 331 and the feed roller 332, which has a specific width along the rotation directions of the developing roller 331 and the feed roller 332, is formed. Since the hardness of the feed roller 332 is lower than that of the developing roller 331, a main deformation of the surface of the feed roller 332 allows the feed nip part SN to be formed as shown in FIG. 3. Therefore, when the developing roller 331 and the feed roller 332 each rotate, the toner transported by the feed roller 332 retains on the upstream side of the feed nip part SN to form a toner reservoir TN. Even when a high density image is formed on the photoconductor drum 31 by the toner reservoir TN, it is possible to supply the toner stably from the feed roller 332 to the developing roller 331.

On the other hand, if the developing roller 331 and the feed roller 332 are in point contact with each other in a cross-sectional view, the toner reservoir TN as shown in FIG. 3 is not sufficiently formed, so that the toner supply may be significantly decreased.

For this reason, it is necessary that the distance between the shafts of the developing roller 331 and the feed roller 332 (the distance between the shafts) and diameters of the developing roller 331 and the feed roller 332 are set so as to achieve an adequate bite amount H. The hardness of the developing roller 331 is set within the range from 50 to 80, both inclusive, in the Asker-C hardness in order to be brought into contact with the hard member such as the photoconductor drum 31. Therefore, in order to cause the developing roller 331 to embed into the feed roller 332 as shown in FIG. 3, it is necessary to set the hardness of the feed roller 332 to be lower than that of the developing roller 331.

Here, the undeveloped toner on the developing roller 331 remains on (adheres to) the surface of the developing roller 331 due to mirror image force, van der Waals force, liquid cross-linking force, electric field energy, etc. In other words, scraping off the undeveloped toner with a frictional force overcoming these energies makes it possible to collect the undeveloped toner from the developing roller 331 by the feed roller 332. Meanwhile, since the friction force is the product of a friction coefficient and the load, by setting a compression load, which is force to press the feed roller 332 against the developing roller 331, within the optimum range, the collectability of undeveloped toner can be significantly improved.

In view of above mentioned action, as a result of carrying out intensive experiments, the inventor of the present invention has newly found that when the hardness of the developing roller 331 is set within the range from 50 to 80, both inclusive, in Asker-C hardness, and the width of the feed nip part between the developing roller 331 and the feed roller 332 along the rotation direction is set within the range from 0.2 mm to 1.5 mm, both inclusive, it is preferable to set the compression load applied to the feed roller 332 within the range from 0.2 N to 1.5N, both inclusive.

According to such a configuration, the toner supplied from the feed roller 332 to the developing roller 331 can be stably maintained, while preventing the occurrence of an uneven image density. Therefore, when the feed roller 332 collects the undeveloped toners from the developing roller 331, the collectability can be improved. In addition, the difference in toner charge between the undeveloped toners and the toner newly supplied from the feed roller 332 to the developing roller 331 makes it possible to suppress a development ghost (ghost) from occurring.

It is further preferable that the hardness of the surface of the feed roller 332 is set within the range from 30 to 50, both inclusive, in the Asker-FP hardness. In this case, it is possible to prevent the developing ghost from occurring due to toners slipping through the feed nip part because of too low hardness of the feed roller 332 as well as to suppress torque for rotating the feed roller 332 from significantly increasing because of too high hardness of the feed roller 332.

Furthermore, it is further preferable that the melt viscosity (Pa·s) of a non-magnetic one-component toner used in the developing device 33 at a temperature 95° C. is set within the range from 10000 to 20000, both inclusive. Even the toner with a relatively low melt viscosity and viscosity likely to increase according to the temperature in the device, it is possible to achieve both the toner supply to the developing roller 331 by the feed roller 332 and the toner collection from the developing roller 331 by the feed roller 332.

EXAMPLES

Next, a preferred aspect of the developing device 33 is described based on some examples. The following examples were conducted under the following experimental conditions.

Experimental Conditions

- Photoconductor drum 31: OPC drum
- Circumferential speed of the photoconductor drum 31: 118 mm/sec
- Circumferential speed of the developing roller 331: 182 mm/sec
- Developing bias DC component: 350 V
- Supply bias DC component: 450 V
- Surface potential of photoconductor drum 31: 640 V
- Diameter of the developing roller 331: 13 mm
- Asker-C hardness of the developing roller: 70
- Diameter of the photoconductor drum 31: 24 mm
- Average particle size of non-magnetic toner: 8.0 μm (D50)

Table 1 shows the detailed conditions and experimental results of examples and comparative examples.

TABLE 1

| | Food roller diameter (mm) | Food roller width (mm) | Nip width (mm) | Compressive load (N) | Compressive load ($10^{-3}$ mN/mm$^2$) | Asker FP hardness | Melt viscosity (Pa · S) | Uneven image density | Ghost | Torque |
|---|---|---|---|---|---|---|---|---|---|---|
| Example 1 | 13.0 | 240.0 | 1.0 | 1.0 | 4.2 | 40 | 150000 | ◎ | ◎ | ◎ |
| Example 2 | 15.0 | 240.0 | 1.0 | 1.0 | 4.2 | 40 | 150000 | ◎ | ◎ | ◎ |
| Example 3 | 11.0 | 240.0 | 1.0 | 1.0 | 4.2 | 40 | 150000 | ◎ | ◎ | ◎ |
| Example 4 | 13.0 | 120.0 | 1.0 | 1.0 | 8.3 | 40 | 150000 | ◎ | ◎ | ◎ |
| Example 5 | 13.0 | 240.0 | 0.2 | 1.0 | 20.8 | 40 | 150000 | ○ | ○ | ◎ |
| Example 6 | 13.0 | 240.0 | 1.5 | 1.0 | 2.8 | 40 | 150000 | ◎ | ◎ | ○ |

TABLE 1-continued

| | Food roller diameter (mm) | Food roller width (mm) | Nip width (mm) | Compressive load (N) | Compressive load ($10^{-3}$ mN/mm$^2$) | Asker FP hardness | Melt viscosity (Pa · S) | Uneven image density | Ghost | Torque |
|---|---|---|---|---|---|---|---|---|---|---|
| Example 7 | 13.0 | 240.0 | 1.0 | 0.2 | 0.8 | 40 | 150000 | ○ | ◎ | ◎ |
| Example 8 | 13.0 | 240.0 | 1.0 | 1.5 | 6.3 | 40 | 150000 | ◎ | ◎ | ○ |
| Example 9 | 13.0 | 240.0 | 1.0 | 1.0 | 4.2 | 30 | 150000 | ◎ | ○ | ◎ |
| Example 10 | 13.0 | 240.0 | 1.0 | 1.0 | 4.2 | 50 | 150000 | ◎ | ◎ | ○ |
| Example 11 | 13.0 | 240.0 | 1.0 | 1.0 | 4.2 | 40 | 100000 | ◎ | ◎ | ◎ |
| Example 12 | 13.0 | 240.0 | 1.0 | 1.0 | 4.2 | 40 | 200000 | ◎ | ◎ | ◎ |
| Comparative Example 1 | 13.0 | 240.0 | 0.1 | 1.0 | 41.7 | 40 | 150000 | X | X | ◎ |
| Comparative Example 2 | 13.0 | 240.0 | 1.6 | 1.0 | 2.6 | 40 | 150000 | ◎ | ◎ | X |
| Comparative Example 3 | 13.0 | 240.0 | 1.0 | 0.1 | 0.4 | 40 | 150000 | X | X | ◎ |
| Comparative Example 4 | 13.0 | 240.0 | 1.0 | 1.6 | 6.7 | 40 | 150000 | ◎ | ◎ | X |
| Comparative Example 5 | 13.0 | 240.0 | 1.0 | 1.0 | 4.2 | 25 | 150000 | ○ | X | ◎ |
| Comparative Example 6 | 13.0 | 240.0 | 1.0 | 1.0 | 4.2 | 55 | 150000 | ◎ | ◎ | X |

In Examples 1 through 12 and Comparative Examples 1 through 6, under various conditions of the diameter of the feed roller 332 (mm), the width of the feed roller 332 in the axial direction (mm), the width of the feed nip part in the rotation direction (mm), the width of the feed roller 332 in the axial direction (mm), compressive load (N) applied to the shaft of the feed roller 332 toward the developing roller 331 (mm), compressive load ($10^{-3}$ mN/mm$^2$) applied to the same, Asker-FP hardness of the feed roller 332, and the melt viscosity of the toner (Pa·s), the uneven image density, the ghost, and torque applied to the developing device 33 were evaluated.

The width of the feed nip part SN was measured from the inside of a test cylinder in the radial direction while the test cylinder made of a transparent polycarbonate, which has the same diameter as the developing roller 331, was placed in contact with the feed roller 332. The compressive load was measured as the feed roller 332 alone using FGC-1 commercially available from Nidec-Simpo Corporation in Japan. In addition, the Asker-FP hardness of the feed roller 332 was measured as the feed roller 332 alone using Asker-FP hardness tester commercially available from Kobunshi Keiki Co., Ltd. in Japan. The melt viscosity of the toner of 1 g was measured using CFT-500D commercially available from Shimadzu Corporation in Japan.

For the evaluation of the uneven image density, a density difference among solid images formed at the left end, the center, and the right end of the sheet were classified in such a way that the density difference of less than 0.1 was denoted as ◎, the density difference of 0.1 or more to less than 0.2 was denoted as ○, and the density difference of 0.2 or more was denoted as x. For the evaluation of the ghost, a 50% halftone image was printed on a sheet after the solid image was printed on another sheet, and an in-plane density difference was classified in such a way that the in-plane density difference of less than 0.05 was denoted as ◎, the in-plane density difference of 0.05 or more to less than 0.1 was denoted as ○, and the in-plane density difference of 0.1 or more was denoted as x. For the evaluation of torque of the developing device 33, torque measured as the developing device 33 alone was classified in such a way that torque of less than 250 mN·m was denoted as ◎, torque of 250 mN·m or more to less than 300 mN·m was denoted as ○, and torque of 300 mN·m or more was denoted as x.

As shown in Examples 1 through 12 in Table 1, when the width of the feed nip part was set within the range from 0.2 mm to 1.5 mm, both inclusive, setting the compression load applied to the feed roller 332 within the range from 0.2N to 1.5N, both inclusive, made it possible to result in a good uneven image density, a good ghost, and a good torque. In this case, since the feed roller 332 can stably collect the undeveloped toners from the developing roller 331, the toner supply from the feed roller 332 to the developing roller 331 can sufficiently follow the high density image formation, and the occurrence of the uneven image density can be suppressed. Furthermore, the collection capability of the feed roller 332 made it possible to suppress an old toner and a new toner from being mixed on the developing roller 331 and to suppress the ghost from occurring. In addition, since there was no case where the feed roller 332 was excessively pressed against the developing roller 331, it resulted in that a drive system rotating and driving the developing roller 331, the feed roller 332, and the stirring paddle 333 of the developing device 33 can be free from a large torque applied thereto.

On the other hand, in Comparative Example 1, since the width of the feed nip part was as narrow as 0.1 mm, the toner reservoir TN was insufficiently formed, and this resulted in the uneven image density and the ghost. In addition, in Comparative Example 2, since the width of the feed nip part was as wide as 1.6 mm, it resulted in that a large torque was applied to the drive system which rotates and drives the developing roller 331, the feed roller 332, and the stirring paddle 333 of the developing device 33. Furthermore, in Comparative Example 3, since the compressive load of the feed roller 332 was as small as 0.1, the feed roller 332 had a low collectability. Therefore, this resulted in the uneven image density and the ghost. Furthermore, in Comparative Example 4, since the compression load of the feed roller 332 was large, it resulted in that a large torque was applied to the drive system which rotates and drives the developing roller 331, the feed roller 332, and the stirring paddle 333 of the developing device 33. Furthermore, in Comparative Example 5, since the hardness of the feed roller 332 was set to 25 in the Asker-FP hardness, the feed roller 332 had a low collectability. Therefore, this resulted in the ghost. Furthermore, in Comparative Example 6, since the hardness of the feed roller 332 was set to 55 in the Asker-FP hardness, friction force between the developing roller 331 and the feed roller 332 was large. Therefore, it resulted in that a large torque was applied to the drive system which rotates and drives the developing roller 331, the feed roller 332, and the stirring paddle 333 of the developing device 33. In Comparative Examples 2, and 4 through 6, the results of the uneven image density were good.

The evaluation results (effects) similar to the above-mentioned results were reproduced in a case where the diameter of the developing roller 331 was within the range from 11.0 mm to 15.0 mm, both inclusive. The evaluation results (effects) similar to the above-mentioned results were reproduced in a case where the circumferential speed ratio of the feed roller 332 to the developing roller 331 (the circumferential speed of the developing roller 331 was faster) fell within the range between 1:1.3 and 1:1.8.

Although the developing device 33 and the image forming apparatus 1 provided therewith according to the embodiment of the present invention have been described, the present invention is not limited thereto, and the following alternative embodiments may be employed, for example.

(1) Although, in the above-mentioned embodiment, the image forming apparatus 1 is provided with a single developing device 33, the image forming apparatus 1 may be a color image forming apparatus provided with a plurality of developing devices 33 corresponding to a plurality of colors.

(2) Although, in the above-mentioned embodiment, the developing housing 330 of the developing device 33 contains the non-magnetic toner inside, a toner container or a toner cartridge to contain the non-magnetic toner may be provided separately from the developing housing 330.

DESCRIPTION OF REFERENCE NUMERALS

1 Image forming apparatus
31 Photoconductor drum
33 Developing device
330 Developing housing
330A Housing body
330B Housing lid
331 Developing roller
332 Feed roller
333 Stirring paddle
334 Restriction blade (layer thickness regulation member)
335 Lower seal

The invention claimed is:

1. A developing device comprising:

a developing housing containing a non-magnetic one-component toner;

a developing roller having a cylindrically shaped elastic body, that is rotatably supported by the developing housing, and is located at a developing nip part so as to face a specific photoconductor drum to carry the toner on a circumferential surface of the developing roller;

a feed roller having a cylindrically shaped foam elastic body, that is rotatably supported by the developing housing, forms a feed nip part between the feeding roller and the developing roller by being brought into contact with the circumferential surface of the developing roller, and collects the toner from the developing roller while supplying the toner to the developing roller; and a layer thickness regulating member to regulate a thickness of the toner on the developing roller, that is brought into contact with the circumferential surface of the developing roller on a downstream side from the feed nip part in a rotation direction of the developing roller, wherein the developing roller has a hardness within a range from 50 to 80, both inclusive, in Asker-C hardness, the feed roller has a hardness to form the feed nip part by being brought into contact with the circumferential surface of the developing roller and being deformed, the feed roller is supported by the developing housing such that a width of the feed nip part along the rotation direction of the developing roller falls within a range from 0.2 mm to 1.5 mm, both inclusive, and a compressive load to regulate friction force between the feed roller and the developing roller is set within a range from 0.2N to 1.5N, both inclusive.

2. The developing device according to claim 1, wherein the hardness of the feed roller is set within a range from 30 to 50, both inclusive, in Asker-FP hardness.

3. The developing device according to claim 2, wherein a melt viscosity (Pa·s) of the toner at 95° C. is set within a range from 10000 to 20000, both inclusive.

4. An image forming apparatus comprising:

the developing device according to claim 2; and a photoconductor drum having a surface on which an electrostatic latent image is formed, and being supplied with the toner from the developing roller.

5. The developing device according to claim 1, wherein a melt viscosity (Pa·s) of the toner at 95° C. is set within a range from 10000 to 20000, both inclusive.

6. An image forming apparatus comprising:

the developing device according to claim 5; and a photoconductor drum having a surface on which an electrostatic latent image is formed, and being supplied with the toner from the developing roller.

7. An image forming apparatus comprising:

the developing device according to claim 1; and a photoconductor drum having a surface on which an electrostatic latent image is formed, and being supplied with the toner from the developing roller.

* * * * *